United States Patent [19]

Vuilleumier et al.

[11] Patent Number: 4,564,836

[45] Date of Patent: Jan. 14, 1986

[54] MINIATURE SHUTTER TYPE DISPLAY DEVICE WITH MULTIPLEXING CAPABILITY

[75] Inventors: Raymond Vuilleumier, Fontainemelon; Paul-Charles Weiss, Neuchatel, both of Switzerland

[73] Assignee: Centre Electronique Horloger S.A., Neuchatel, Switzerland

[21] Appl. No.: 392,073

[22] Filed: Jun. 25, 1982

[30] Foreign Application Priority Data

Jul. 2, 1981 [CH] Switzerland ..... 4360/81

[51] Int. Cl.[4] ..... G09G 3/34

[52] U.S. Cl. ..... 340/783; 340/763

[58] Field of Search ..... 340/764, 763, 815.27, 340/815.24, 783

[56] References Cited

U.S. PATENT DOCUMENTS

| | | | |
|---|---|---|---|
| 3,460,134 | 8/1969 | Aiken | 340/764 |
| 3,600,798 | 8/1971 | Lee . | |
| 3,648,281 | 3/1972 | Dahms et al. | 340/815.27 |
| 3,886,310 | 5/1975 | Guldberg . | |
| 3,924,226 | 12/1975 | Lacy et al. | 340/764 |
| 4,229,732 | 10/1980 | Hartstein et al. | 340/815.24 |
| 4,336,536 | 6/1982 | Kalt et al. | 340/764 |
| 4,383,255 | 5/1983 | Grandjean et al. | 340/764 |

FOREIGN PATENT DOCUMENTS

| | | |
|---|---|---|
| 2071896 | 9/1971 | United Kingdom . |
| 1279544 | 6/1972 | United Kingdom . |
| 1545761 | 5/1979 | United Kingdom . |
| 1593011 | 7/1981 | United Kingdom . |

OTHER PUBLICATIONS

Aiken, W. R., "An Electrostatic Sign—The Distec System", Display Technology Corp., Cuperinto, California.

*Primary Examiner*—Marshall M. Curtis

*Attorney, Agent, or Firm*—Parkhurst & Oliff

[57] ABSTRACT

A display device comprising an insulating carrier (1) and shutters (V) which are capable of rotating under the effect of an electrical field (E) which is perpendicular to the plane of the carrier. The shutters (V) are grouped in pairs and are controlled by applying a voltage between a shutter and a counter-electrode (c). The control may be multiplexed if the shutters of the same pair have different potentials applied thereto.

17 Claims, 7 Drawing Figures

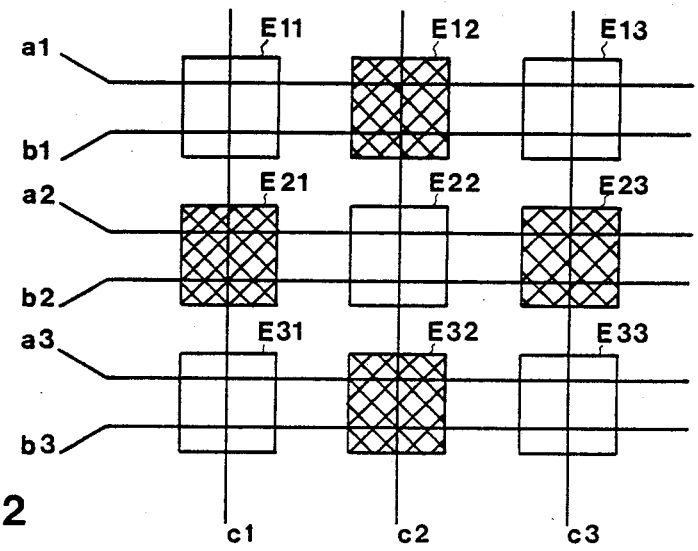
FIG.2
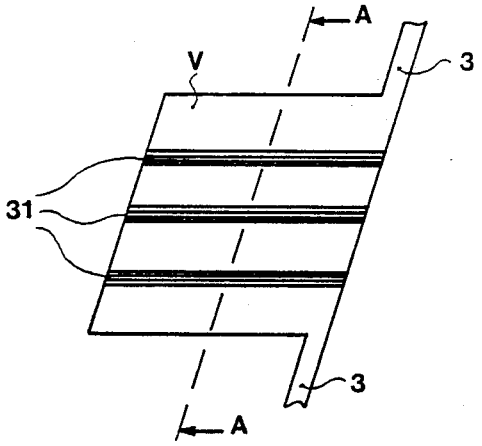
FIG.4.a
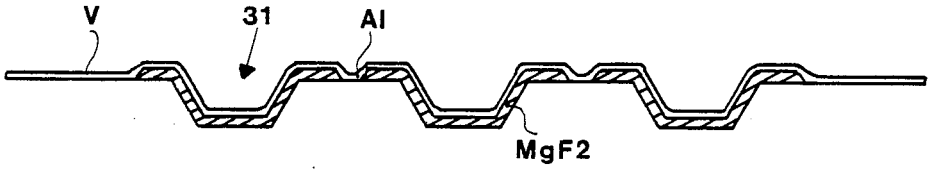
FIG.4.b

MINIATURE SHUTTER TYPE DISPLAY DEVICE WITH MULTIPLEXING CAPABILITY

The present invention relates generally to display devices and more particularly a miniature display device of the electrostatic type, for the production of display cells which can be used in particular in portable battery-powered equipment such as electronic calculators and watches.

Considerable efforts have been made to find and develop display systems which are attractive in appearance, which operate with a low supply voltage, which have a very low level of power consumption and which can be inexpensively produced. Liquid crystal display devices fulfilled those conditions until the level of consumption of electronic circuits and in particular CMOS integrated circuits fell to such a point that the amount of power consumed by the display, in relation to the overall consumption, ceases to be negligible. In addition, such devices are complicated to control and the contrast and aesthetic appearance thereof are not as good as they might be.

Among display devices which have a low level of consumption, mention may be made of the device which is known as "The Distec System", as described in the document "An Electrostatic Sign—The Distec System", W. R. Aiken, Display Technology Corp., Cupertino, Calif., USA. That device is used as an advertising panel or sign of large dimensions. It comprises modules formed by shutters which are suspended from an axis by hinges and which are capable of rotating under the effect of an electrical field applied by a system of electrodes. The control voltage is about 3000 volts. However, it has never been suggested that that system might be adapted to produce a miniature display with a low control voltage.

Light-modulating devices are also known, using membranes which are deformable under the effect of an electrical field or an electron beam, and which can be produced by means of methods derived from the manufacture of integrated circuits. Such modulating devices are described for example in U.S. Pat. Nos. 3,600,798 and 3,886,310. The first document shows a device for modulating the amount of light transmitted by deformation of a membrane under the effect of an electrical field, while the second document discloses a device for modifying the angle of reflection of the light, by deformation of a membrane under the effect of an electron beam. However, neither of these devices forms a display device, the amplitude of the movement of the membrane in both cases being very low and the devices also requiring the provision of a supplementary light source.

An object of the present invention is a miniature display device which has a very low level of power consumption, enjoys excellent contrast, operates at a low supply voltage and which can be produced using the technology of integrated electronic circuits.

Another object of the present invention is a miniature display device, the control of which can be multiplexed.

To achieve these objects, a display device according to the invention comprises a carrier provided with cavities and shutters which are held to the carrier by resilient attachment means, said shutters closing said cavities in the rest position and being capable of rotating under the effect of an electrical field, to open the cavities; said device being characterized in that it comprises:

at least one pair of shutters per cavity, each shutter of a pair being held to said carrier by two resilient attachment means which are disposed on respective sides of the shutter and in alignment with the side adjacent to the other shutter of said pair;

control means for generating an electrical field capable of causing one or more pairs of shutters to rotate; and holding means for holding the two shutters of a pair in an activated condition in the absence of said electrical field which is required to cause them to rotate.

Other objects, features and advantages of the present invention will be more clearly apparent from the following description of particular embodiments, given purely by way of illustration, and with reference to the accompanying drawings in which:

FIG. 2 shows an example of a display in a matrix arrangement of display elements;

Figure 5:
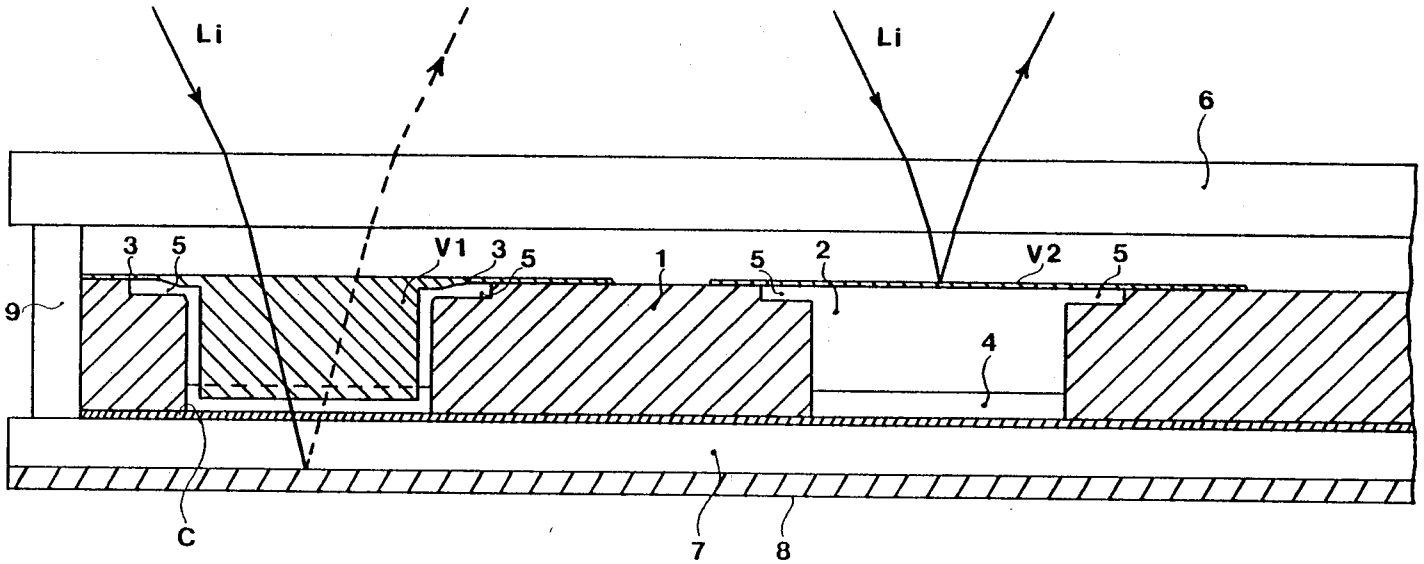
Figure 6:
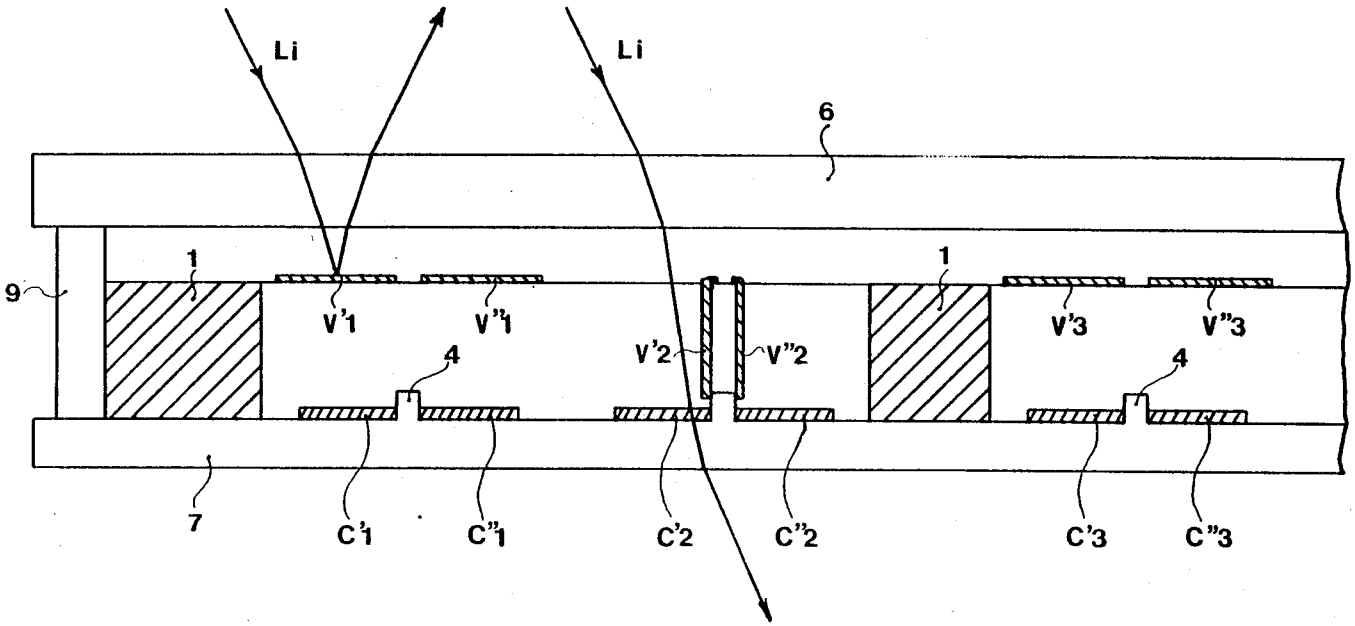

FIGS. 4*a* and 4*b* show an embodiment of the shutter;

FIG. 5 is a view in cross-section of part of the display device according to the invention; and FIG. 6 shows a view in cross-section of another embodiment of the display device according to the invention.

Figure 1:
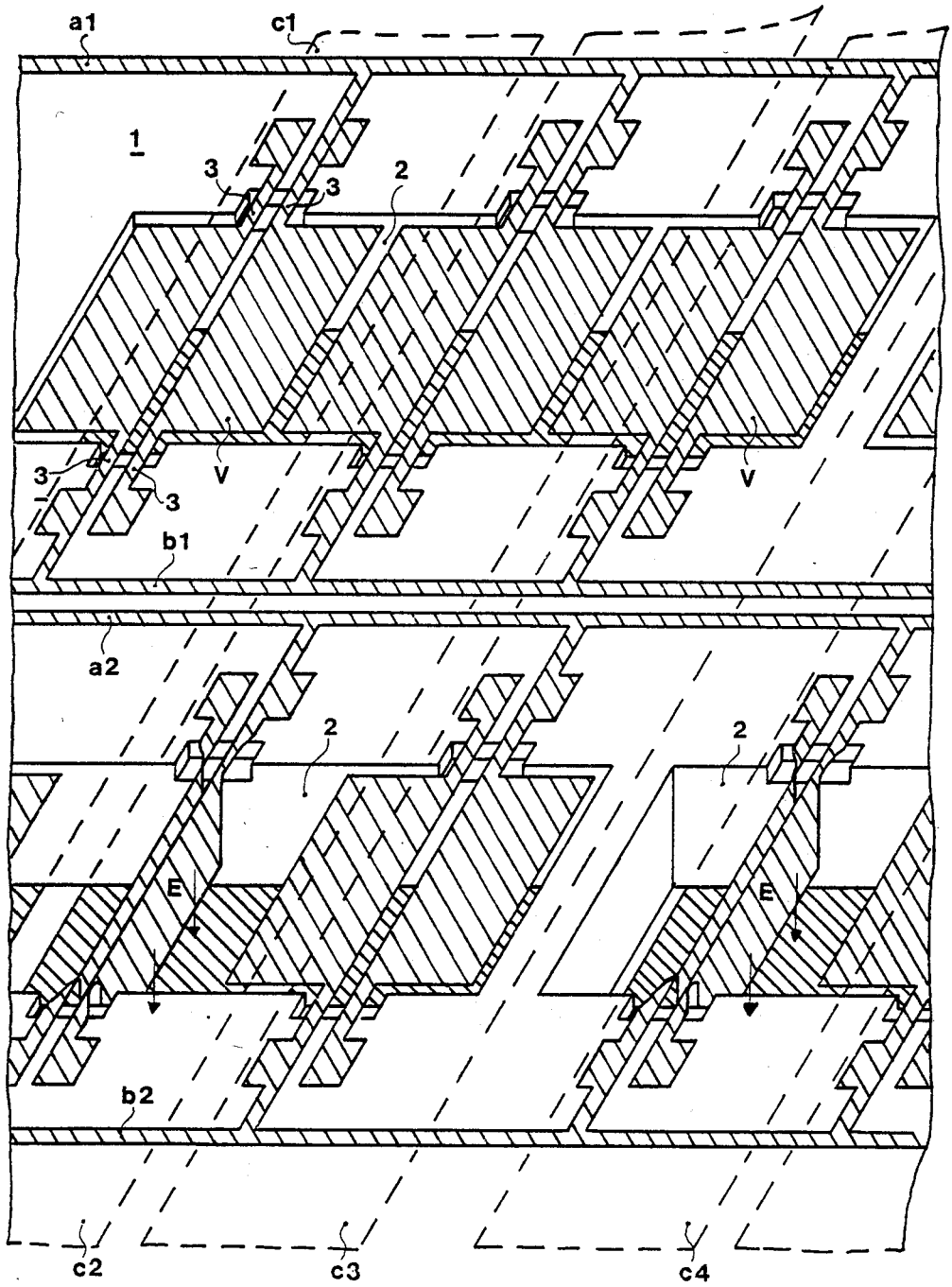
FIG. 1 is a diagrammatic view of part of the display device according to the invention.

FIG. 1 is a diagrammatic view of part of the display device according to the invention. An insulating support or carrier 1 is provided with a plurality of cavities 2 of generally rectangular shape. The cavities 2 are closed off by shutters V, which are also rectangular in shape and which are attached to the carrier 1 by two resilient attachment means 3 disposed on respective sides of the shutters. The shutters V are grouped in pairs and are such that the resilient attachment means 3 of the shutters of the same pair are disposed in alignment with the adjacent sides thereof. The shutters V and the attachment means thereof are at least partly formed by a conducting material. In the same row of shutters, one shutter of each pair is connected to a first electrode a1 or a2 while the other shutter is connected to a second electrode b1 or b2. Associated with each column of pairs of shutters is a counter-electrode or control electrode c1 to c4 which can be seen facing each pair of shutters, on the bottom of the cavities 2.

The display device shown in FIG. 1 operates in the following manner:

When a control voltage, being a d.c. or an a.c. voltage, is applied between the shutters V on the one hand and the control electrode which is associated therewith on the other hand, the shutters move out of their rest position and, under the effect of the electrical field E produced by the control voltage, rotate about their resilient attachment means 3 to take up a position in which they are oriented substantially perpendicularly to the plane of the carrier. The angle through which the shutters turn depends both on the strength of the electrical field which is thus produced, and the return torque produced by the resilient attachment means of the shutters, when the shutters have moved out of their rest position. When a pair of shutters is actuated, the shutters of that pair are very close to each other and it is then sufficient for a holding voltage to be applied between the shutters, that is to say, between the electrodes a1 and b1 or a2 or b2, in order for the shutters to be mutually attracted so that the control voltage can be removed. The shutters V return to their rest position, that is to say, parallel to the plane of the carrier 1, by virtue of the return torque produced by the resilient attachment means 3, when the control and holding voltages are removed.

As will be seen hereinafter, the above-described mechanisms for controlling and holding the shutters afford the advantage of permitting multiplexed control of the device according to the invention.

Figure 3:
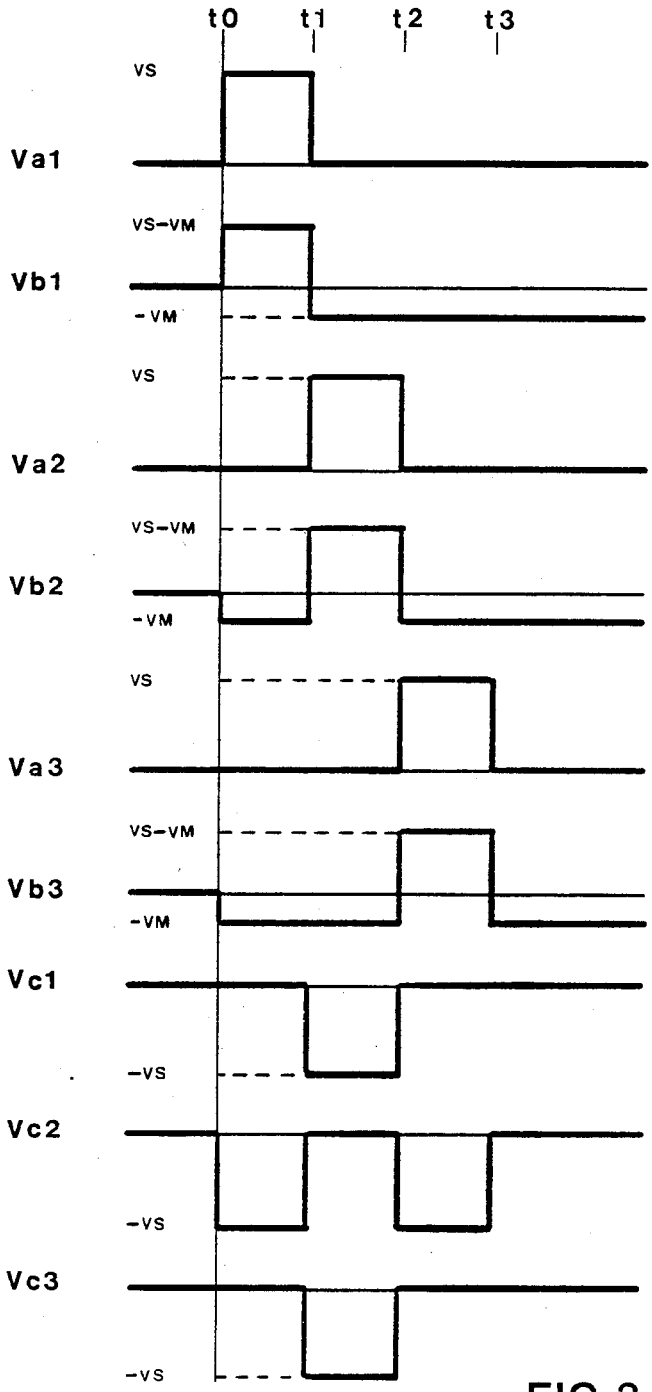
FIG. 3 is a diagram showing the control and holding voltages for producing the display shown in FIG. 2.

An example of multiplexed control will be described in greater detail with reference to FIGS. 2 and 3. FIG. 2 is a diagrammatic view of a matrix arrangement of nine display elements E11 to E33 which are arranged in three rows and three columns. Each display element is to be understood as comprising at least one pair of shutters, one of which is connected to a first row electrode a1, a2 or a3, while the other is connected to a second row electrode b1, b2 or b3. The elements of a given column are controlled by the same control electrode c1, c2 or c3. The diagram illustrated in FIG. 3 shows an example of the signals to be applied to the row and column electrodes to permit display of the elements E12, E21, E23 and E32 in FIG. 2. At the moment t0, all the elements are set to zero. Then, from moment t0 to moment t3, the three rows are activated in time succession. Thus, voltages VS and VS-VM are respectively applied to the row electrodes a1 and b1 between moments t0 and t1, to row electrodes a2 and b2 between moments t1 and t2 and to row electrodes a3 and b3 between moments t2 and t3. Display of one or more elements of a given row is controlled by applying a voltage −VS to the corresponding control electrode or electrodes, simultaneously with activation of said row. Display of the elements of a given row, outside of the period of time during which that row is activated, is maintained by means of the holding voltage VM which is applied between the row electrodes. In the embodiment illustrated, the holding voltage is in continuous existence as long as the display is not reset to zero. In actual fact, for a given row, the holding voltage is required only outside of the periods of activation of that row and insofar as elements in that row are to be displayed. The voltage VS is such that it is insufficient to cause the shutters to rotate completely, while double the value of the voltage VS, that is to say, 2 VS, causes the shutters to rotate completely (it is accepted that the shutters have rotated completely if they can be held by the holding voltage). Thus, when an element is not to be displayed, its row electrodes to which the shutters of that element are connected are subjected to a voltage VS, except for the voltage VM for the second electrode, while its control electrode is maintained at zero potential.

The shutters V must be conducting. It will be seen hereinafter that an advantageous solution in this respect comprises making the shutters of aluminum on an insulating support or carrier such as silicon. It will be appreciated however that means must be provided in order that the shutters of the same pair can never be in electrical contact with each other. One of such means will now be described with reference to FIGS. 4*a* and 4*b*.

FIG. 4*a* shows a shutter V which is provided with ribs 31, and its resilient attachment means 3, while FIG. 4*b* shows a view taken in section along line A—A in FIG. 4*a*. As will be seen from FIG. 4*b*, the shutter V is made in part of a conducting material (for example aluminum) and in part of an insulating material (for example magnesium fluoride). The conducting portion covers the whole of the upper part of the shutter while the insulating portion occurs, on the lower part of the shutter, only at the location of the ribs 31. The ribs 31 are so disposed that, when two shutters of the same pair are activated, the insulated portions thereof are disposed facing each other, thereby fixing the distance between the conducting portions of the shutters. The provision of ribs therefore makes it possible to insulate the shutters of the same pair. The ribs also afford the advantage of making the shutters rigid and enhancing their aesthetic appearance.

Another way of avoiding electrical contact between the shutters of the same pair comprises providing a stop means on the bottom of the cavity. The stop means may be formed by a boss 4 (see FIGS. 5 and 6) on the bottom of the cavity, which extends below the axes of rotation of the shutters and the width of which is approximately equal to the distance between two shutters of the same pair.

FIG. 5 shows a view in cross-section of part of the display device according to the invention. Components which are identical to those shown in FIG. 1 are denoted by the same references. Thus, FIG. 5 shows the insulating carrier 1 which is provided with cavities 2. Shutters V1 and V2 are also shown, one shutter V1 being illustrated in the activated position while the other shutter V2 is illustrated in the rest position. The carrier 1 rests on a transparent plate 7 which, on its inward surface, carries the control electrodes C which are themselves transparent. On its outside surface, the transparent plate 7 is covered by a layer 8 of light-absorbing material. The upper surface of the device is protected by a second transparent plate 6 which is held at a suitable spacing by spacer elements 9. The transparent plates 6 and 7 and the spacer elements 9 form a protective chamber for the device, which chamber may be sealed. By way of example, the transparent walls may be of glass and the spacer elements may be of plastic material. FIG. 5 also shows clearance recesses which are provided in the carrier 1, below the resilient attachment means 3. The purpose of the recesses 5 is to act as a support for the resilient attachment means and to restrict the movement of the shutters in a downward direction, in such a way that they can never touch the bottom of the cavities. Also shown in FIG. 5 is one of the above-mentioned stop means. The stop means illustrated comprises a boss 4 which is formed at the bottom of the respective cavity 2 and which prevents the shutters of a given pair from coming into contact with each other in the activated position. FIG. 5 also shows the manner in which the incident rays Li are reflected by the shutters such as V2 in the rest position, or are absorbed by the layer 8 of light-absorbing material when the shutters as at V1 are in the activated position.

FIG. 6 is a view in cross-section of part of an alternative embodiment of the invention. In this embodiment, each control electrode is actually formed by two electrodes. Thus, C'1 and C''1 form the electrodes for controlling the first column of shutters such as V'1 and V''1, C'2 and C''2 form the electrodes for controlling the second column of shutters such as V'2 and V''2, and so on for each column of shutters. The electrode C'1 is associated with the shutter V'1 and the electrode C''1 is associated with the shutter V''1. The pair of shutters V'1 and V''1 will be activated for example by applying a voltage VS−(VM/2) to the shutter V'1, a voltage −VS−(VM/2) to the control electrode C'1, a voltage VS+(VM/2) to the shutter V''1, and a voltage −VS+(VM/2) to the control electrode C"1. In this embodiment, the same voltage difference 2 VS exists between a shutter and its control electrode, which was not the case in the above-described embodiments. The control voltages may alternate from one pair to the following pair, in order to ensure that the holding voltage VM does not occur between two adjacent shutters of two separate pairs. Thus, with the voltages indicated above, in respect of the pair of shutters V'1 and V"1, the shutters V'2 and V"2 will be respectively raised to the potentials VS+(VM/2) and VS−(VM/2) and −VS−(VM/2).

Another way of providing control of the device shown in FIG. 6, which is also advantageous, comprises applying a voltage +VS to the shutter V'1 and to the control electrode C"1, and a voltage −VS to the shutter V"1 and to the control electrode C'1. The shutters are then activated by means of a voltage which is equal to 2VS, and they will be held in the activated position even if the control electrodes are returned to zero voltage.

FIG. 6 also shows that the device may also be used in a transmission mode when there is no layer of absorbing material. In that case, the shutters act as optical valve means which permit the incident light Li to pass when the shutters are in an activated position and which reflect the incident light when they are in a rest position.

The device according to the invention may advantageously be produced by using the technology of electronic integrated circuits. In that case, the carrier will be a silicon wafer. The shutters, the resilient attachment means thereof and the row electrodes will be produced by depositing and etching a layer of aluminum which is from about 50 to 200 nanometers in thickness, on a first face of the wafer. If the shutters comprise ribs, the operation of depositing aluminum will be preceded by first etching the wafer, then depositing and etching the insulating layer ($MgF_2$). The cavities will be produced by attacking the silicon at the second face of the wafer. When the attack reaches the lower surface of the shutters, the attack operation is stopped and the shutters are freed. The bottom of the respective cavities is formed by a glass plate on which the transparent control electrodes are deposited using methods known in relation to liquid crystal display arrangements.

The device according to the invention may be produced by using base materials other than silicon. Thus, the carrier may also be an insulating material such as sapphire or a plastic material such as those marketed under the names "Kapton" or "Mylar".

Although the present invention has been described by reference to particular embodiments, it will be clearly appreciated that it is in no way limited to these embodiments and that it may be the subject of modifications and alterations without thereby departing from the scope of the invention. In particular, it is clear that the device according to the invention may be produced in the form of a point matrix, each point being formed by one or more pairs of shutters, or in the form of segments which are themselves formed by a plurality of pairs of shutters. Moreover, the use of a wafer of semiconductor material makes it possible for the display and its control circuits to be produced at the same time.

What is claimed is:

1. A miniature display device comprising a carrier having cavities therein and shutters which are fastened to the carrier by resilient attachment means at opposite edges of said shutters, said shutters closing said cavities in their rest condition and capable of rotating through a substantial angle under the effect of an electrical field to open the cavities; said device additionally comprising:

at least one pair of shutters per cavity, each shutter of a pair being fastened to said carrier by two resilient attachment means which are disposed on respective sides of the shutter and in alignment with the side adjacent to the other shutter of said pair;

first electrodes which are disposed on said shutters;

second electrodes which are disposed on a bottom of said cavity;

means for applying a control voltage between two said first and second electrodes to cause at least one pair of said shutters to rotate to an activated condition substantially parallel to each other and substantially perpendicular to the bottom of the corresponding cavity; and means for subsequently applying a holding voltage between the electrodes of the said activated two shutters of each said pair of shutters for holding the said two shutters in the activated condition in the absence of said control voltage.

2. The display device of claim 1 further comprising stop means for preventing electrical contact between the electrodes of said shutters when said shutters are activated.

3. The display device of claim 2 wherein said stop means comprise bosses on the bottom of said cavities.

4. The display device of claim 2 wherein said stop means comprises an insulating layer which at least partially covers the lower surfaces of said shutters.

5. The display device of claim 1 wherein clearance recesses are located in said carrier below said resilient attachment means.

6. The display device of claim 2 disposed within a closed chamber having first and second walls which are substantially parallel to a face of said carrier, and said first wall is transparent.

7. The display device of claim 6 wherein said carrier is fixed with respect to said second wall which forms the bottom of said cavities on which said second electrodes are located.

8. The display device of claim 7 wherein said second wall at least partially comprises a light-absorbing material.

9. The display device of claim 7 wherein said second wall and said second electrodes are transparent.

10. The display device of claim 2 wherein said pairs of shutters are disposed in rows and in columns and said first electrodes of a row are connected together and said second electrodes of a column are connected together.

11. The display device of claim 10 additionally comprising means for time multiplexing of the control voltages of said rows.

12. The display device of claim 10 wherein said second electrodes are each formed by two half-electrodes.

13. The display device of claim 2 wherein said carrier comprises silicon.

14. The display device of claim 13 wherein said shutters and the resilient attachment means thereof comprise aluminum.

15. A display device according to claim 11 wherein said time multiplexing control means includes means for applying two signals to two respective row electrodes to activate said display.

16. A display device according to claim 11 wherein said time multiplexing control means includes means for controlling display of at least one element of a row by applying a signal to the corresponding second electrode simultaneously with activation of said row.

17. The display device according to claim 15 additionally comprising means for applying a holding voltage between said electrodes for maintaining display of at least one element of a row outside of a period of activation by said two signals.

* * * * *